United States Patent [19]

Kasper

[11] 4,070,548

[45] Jan. 24, 1978

[54] MODULAR INTERCONNECTION SYSTEM

[75] Inventor: Alan Henry Kasper, Cicero, Ill.

[73] Assignee: Bunker Ramo Corporation, Oak Brook, Ill.

[21] Appl. No.: 578,749

[22] Filed: May 19, 1975

[51] Int. Cl.[2] ..... H01R 13/50

[52] U.S. Cl. ..... 179/1 PC; 339/154 A

[58] Field of Search ..... 179/1 PC; 339/153, 154, 339/154 A, 198 R, 198 GA, 155 T, 156 T, 92 R, 176 R, 92 M

[56] References Cited

U.S. PATENT DOCUMENTS

| | | | |
|---|---|---|---|
| 1,834,776 | 12/1931 | Halvorson | 339/154 L |
| 2,965,719 | 12/1960 | Mclure | 179/1 PC |
| 3,277,426 | 10/1966 | Klostermann | 339/176 R |
| 3,364,458 | 1/1968 | Black | 339/154 A |
| 3,657,682 | 4/1972 | Iversen | 339/92 M |
| 3,666,886 | 5/1972 | Schneider | 339/156 T |
| 3,760,328 | 9/1973 | Gengopulos | 339/198 R |
| 3,803,530 | 4/1974 | Lapraik | 339/198 |

OTHER PUBLICATIONS

Catalog: "Gold Book", Hayden Publ., 1974–1975, p. 73 (AMP) and pp. 94, 101 (Amphenol).

Catalog: "EEM", McGraw-Hill, 1966, p. 859 (Pomono Electronics: "CRT Adapters").

Data International Sciences, Inc. "Model 50 Data Interface Access Panel" June 23, 1971.

*Primary Examiner*—Kathleen H. Claffy
*Assistant Examiner*—E. S. Kemeny
*Attorney, Agent, or Firm*—William Lohff; F. M. Arbuckle

[57] ABSTRACT

A mounting bracket is carried by an end flange of a first electrical connector and includes projections which slidably engage grooves in a second electrical connector which is supported by the bracket. A hood covers the rear end of the first connector and at least partially covers and embraces the second connector supported by the bracket and includes an internal lateral projection which engages a hook-shaped portion of the bracket. The contact capacity of the first connector is greater than that of the second connector and electrical connections extend, within the hood, to connect the contacts of the second connector to contacts in selected positions of the first connector, so that selected conductors of a multi-conductor cable can be extended to the conductors of another multi-connector cable which has a lesser number of conductors, by way of cooperable connectors which are matable with the first and second connectors.

28 Claims, 10 Drawing Figures

MODULAR INTERCONNECTION SYSTEM

BACKGROUND OF THE INVENTION

1. Field of the Invention

This invention relates to modular interconnection systems, and is more particularly concerned with a modular telephone connection system for interconnecting circuits in telephone signal equipment to circuits in a telephone station.

2. Description of the Prior Art

Telephone sets, and associated interconnection hardware, have become modular as telephone companies have endeavored to combat increasing service expense, particularly in the areas of splicing, wiring, customer installations and equipment rearrangement which involve a great deal of labor. This trend towards modular construction and a variety of modular jack and plug combinations are discussed by Albin R. Meier, in his article "The modular telephone-- a money-saving idea whose time has come", Telephony, Nov. 25, 1974, pp. 27–33. The interconnection apparatus in this article relates to connections between a subset and the handset, and between the subset and a wall jack.

In a well known interconnection technique, a cable is extended from the telephone signaling and switching equipment to a telephone station via a pair of mating connector units, hereinafter simply called connectors. In this manner, a number of circuits can be extended to the connector which is connected to the telephone signaling and switching equipment, and selected ones of those circuits can be extended from the matable connector to the telephone station by simply providing the latter connector with less than a full complement of contacts at selected positions. This adds a certain amount of flexibility for an interchange between a regular telephone station and a multi-function station, such as a key telephone station. Among those connectors which have been utilized in this type of interconnection system is the Series 57 connector manufactured by Amphenol Industrial Division of Bunker Ramo Corporation, the assignee of the present invention.

SUMMARY OF THE INVENTION

It is the primary object of the present invention to provide an interconnection system, particularly a telephone interconnection system, which has the advantages of the aforementioned techniques and in which the modular concept is provided with added flexibility in the interconnection of telephone signaling and switching equipment and telephone stations.

According to the invention, telephone signaling and switching equipment is connected to a telephone station by way of apparatus which includes a first cable having a plurality of first electrical conductors for electrical connection to contact points of the signaling and switching equipment and for connection to contacts of a first electrical conductor. A second electrical connector, matable with the first electrical connector, and has a lesser number of contacts for extension of selected ones of the circuits of the signaling and switching equipment to a telephone station. The second connector has its contacts connected to contacts of a connector adaptor assembly, in itself a third electrical connector, which is matable with a fourth electrical connector. A second cable includes a lesser number of conductors than the first cable, these conductors being extended to a telephone station. The connection of the second cable to the telephone station may advantageously be accomplished in accordance with the aforementioned Meier article.

The connector adapter assembly, or third electrical connector as it is sometimes referred to herein, is in the form of a dielectric body which mounts its associated contacts and which, in turn, is mounted on the second electrical connector. As disclosed in greater detail hereinbelow, the structure for mounting the third electrical connector on the second electrical connector comprises a mounting bracket having a base which is received between a pair of downwardly extending legs on the dielectric body of the third electrical connector and a pair of upwardly extending projections which are received in respective grooves in the dielectric body of the third electrical connector. A hood is adapted to slide over and cover the rear of the second electrical connector and to at least partially cover the dielectric body of the third electrical connector and hold the same on the mounting bracket.

The second electrical connector includes a pair of end flanges. The first of these end flanges is slidingly received in a slotted portion of the hood, while the other end flange has the mounting bracket secured thereon. The hood is constructed with resilient sidewalls which are directed slightly inwardly so as to tightly embrace the second and third electrical connectors. The hood is also provided with lower edges and internal guide rails which slidably engage flanges and shoulders, respectively, of the second electrical connector as the hood is moved toward its final position.

BRIEF DESCRIPTION OF THE DRAWINGS

Other objects, features and advantages of the invention, its organization, construction and operation will be best understood from the following detailed description taken in conjunction with the accompanying drawings, on which.

DESCRIPTION OF THE PREFERRED EMBODIMENT

Figure 1:
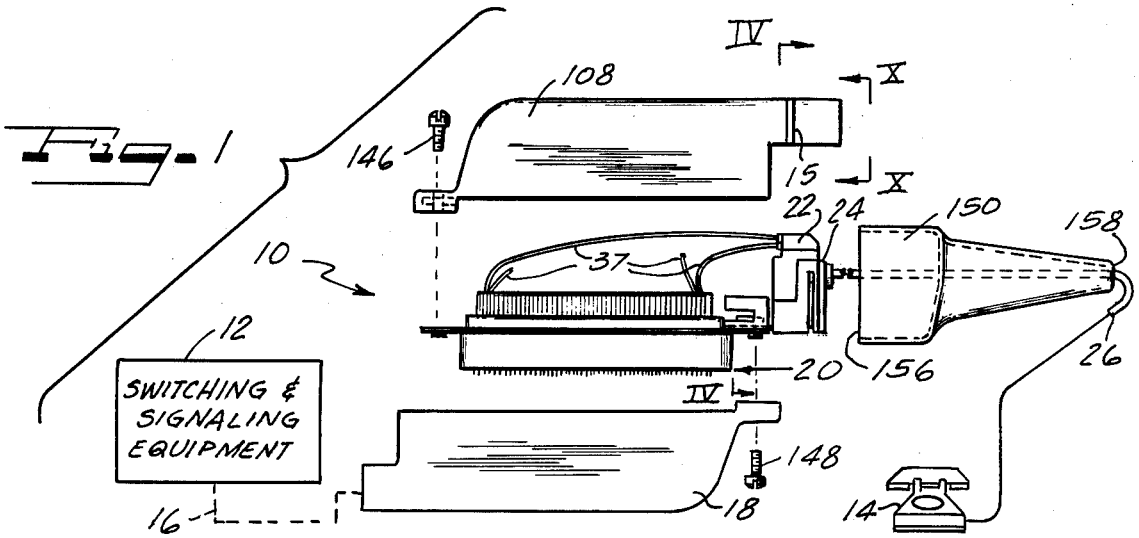
FIG. 1 is a schematic representation of a telephone connection arrangement between telephone switching and signaling equipment and a telephone station, in which connector apparatus constructed in accordance with the invention is illustrated in a partially exploded elevational view.
Figure 3:
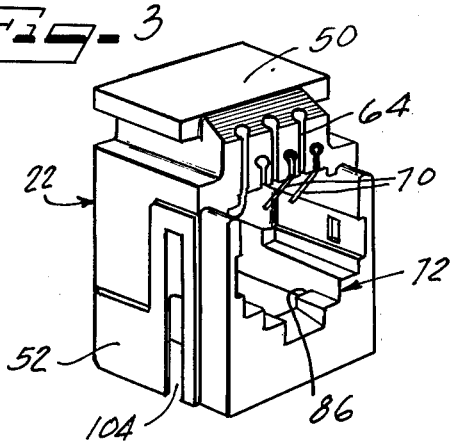
FIG. 3 is a perspective view of an electrical connector which is employed in conjunction with another connector as a connector adaptor for connecting selected ones of a number of circuits to a lesser number of circuits.
Figure 4:
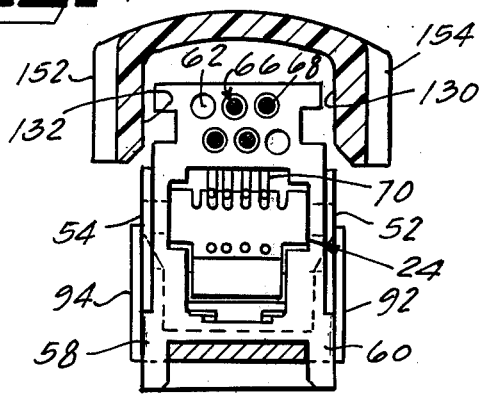
FIG. 4 is a sectional view taken substantially along the line IV—IV of FIG. 1, illustrating the hood in closer proximity to the remainder of the connector apparatus.
Figure 5:
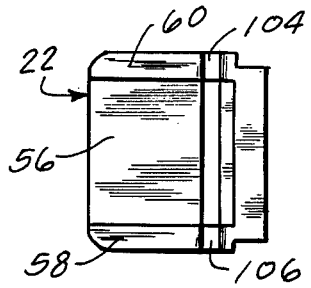
FIG. 5 is a bottom plan view of the electrical connector of FIG. 3.

Referring to FIG. 1, a telephone connection arrangement 10 is schematically illustrated for interconnecting telephone switching and signaling equipment 12 to a telephone station 14. The telephone connection arrangement 10 comprises a cable 16 having a plurality of conductors which are individually connected to one end to circuit contact points of the switching and signaling equipment 12 and at the other end to individual contacts of an electrical connector 18 (shown in phantom). The connector 18 is constructed complementary to and is matable with a second connector 20 on which is mounted a third connector 22, as will be described in greater detail below. The connector 22 is a socket-type connector and receives therein a complementary matable plug-type connector 24. The connector 24 is connected to the telephone station 14 by way of a cable 26 which also has a plurality of individual conductors. The cable 26 has fewer conductors than the cable 16; therefore, and as will be understood from the description below, the intervening connector apparatus constitutes a circuit reduction structure by which selected ones of the circuits of the switching and signaling equipment 12 are extended to the telephone station 14.

Figure 2:
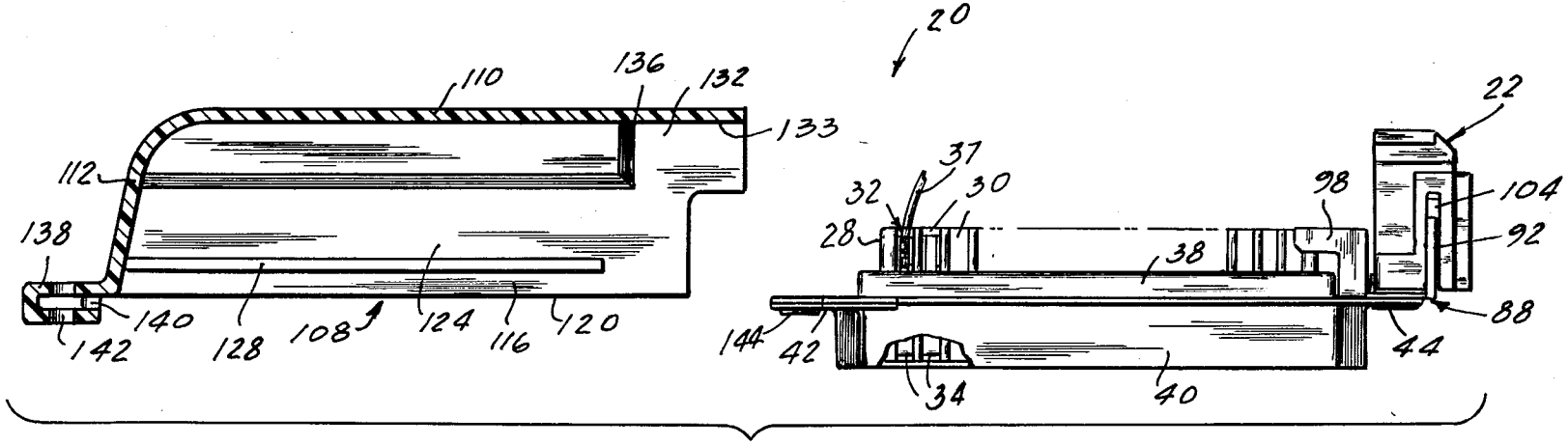
FIG. 2 is a more detailed elevational view of connector apparatus constructed in accordance with the invention, particularly illustrating a hood in longitudinal section positioned for sliding engagement with other parts of the connector apparatus.

Referring to FIG. 2, the electrical connector 20 is illustrated as an elongate electrical connector which comprises a dielectric body 28 having a plurality of spaced barriers 30 which define channels for receiving individual contacts 32. Each of the contacts 32 includes a forward active portion 34 and a tail portion 36. The forward active portion 34 is matable with a corresponding contact of the complementary connector 18, while the tail portion 36 is electrically connected, as by solder, crimp or insulation-pierce techniques, to an individual conductor 37 which leads to the connector 22.

Figure 9:
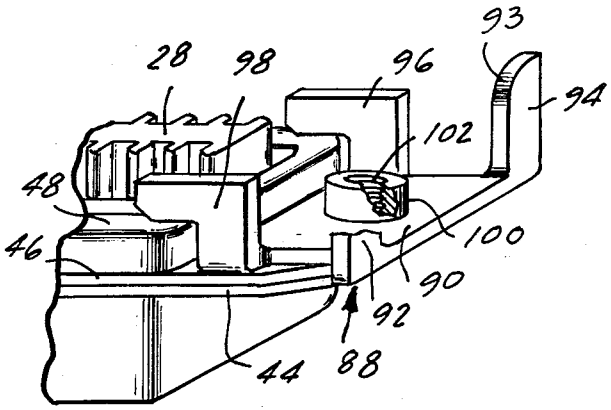
FIG. 9 is a perspective view of one end of an elongate electrical connector, particularly illustrating a mounting bracket for mounting a connector of the type illustrated in FIG. 3, as illustrated in FIGS. 1, 2 and 4.

The dielectric body 28 is a dielectric insert for a shell which comprises a top shell portion 38 and a bottom shell portion 40 which are connected together with the top shell portion 38 embracing the dielectic insert 28 and the bottom shell portion 40 defining a forward end of the connector for engagement with a complementary portion on the mating connector 18. The top and bottom shell portions are connected together in any suitable manner, such as by riveting. For example, the top and bottom shell portions include flange portions which together form an end flange 42 and an end flange 44. An integrally formed apertured rivet 144 on the top shell portion extends through an aperture therebelow in the bottom shell portion and is flared against the lower surface of the flange 42 to effect a connection, while a separate apertured rivet is used for this purpose at the flange 44, as is best illustrated in FIG. 9 where a rivet 100 is shown. The rivet 100, as pointed out below, includes a threaded aperture 102 for receiving a connecting screw 148 (FIG. 1).

Referring to FIGS. 1–5, the connector 22 is illustrated as being mounted on the connector 20 and as comprising a dielectric body which includes a top 50, a pair of sidewalls 52 and 54, a recess 56 formed between a pair of downwardly extending legs 58 and 60, a plurality of contact passages 62 in communication with respective slots 64, and a plurality of contacts 66 each of which includes a tail portion 68 and an active portion 70.

The connector 22 also includes a shaped passage 72 for receiving the connector 24 therein.

Figure 6:
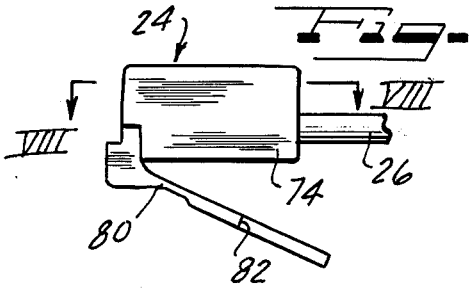
FIG. 6 is an elevational view of a jack-type electrical connector which is matable with the connector of FIG. 3 and which includes a latching mechanism.
Figure 7:
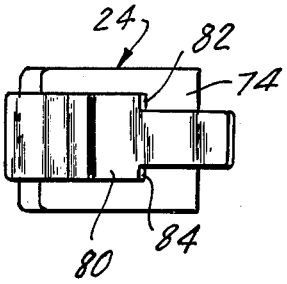
FIG. 7 is a bottom plan view of the connector of FIG. 6 showing the latching mechanism in greater detail.
Figure 8:
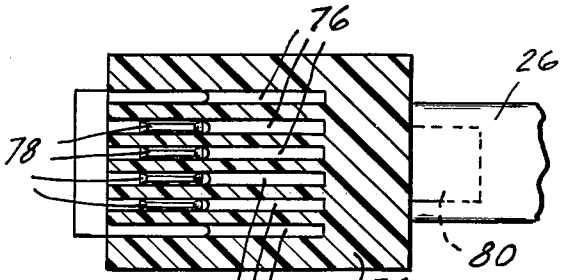
FIG. 8 is a sectional view of the connector of FIG. 6 taken substantially along the line VIII—VIII.

FIGS. 6, 7 and 8 illustrate the connector 24 as a plug-type connector which comprises a dielectric body 74 having a plurality of slots 76 therein for slidingly receiving the active portions 70 of the contacts 66. Each of the slots 76 has a contact 78 mounted therein and each of the contacts 78 is connected to a separate conductor of the cable 26. The dielectric body 74 also includes a latch mechanism which comprises an integrally formed latch arm 80 having a pair of shoulders 82 and 84 which engage a pair of shoulders 86 (only one illustrated) within the shaped passage 72 of the connector 22. In order to disengage the plug and socket connection of the connectors 22 and 24, one moves the latch arm 80 toward the body 74 so that the shoulders 82 and 84 clear the shoulders 86, and then withdraws the connector 44.

Referring to FIGS. 1–5 and 9, the structure for mounting the connector 22 on the connector 20 is illustrated as comprising a bracket 88 having a base 90 with one end portion which is secured to the flange 44 by means of the aforementioned rivet 100 and a second end portion for supporting connector 22. The bracket 88 also includes a pair of side projections 92 and 94 which are received in a pair of grooves 104 and 106 in the sidewalls 114 and 116, respectively, of the connector 22 with the active portions 70 oriented away from the tail portions of connector 20. As the connector 22 is moved downwardly and the projections 92 and 94 are received in the grooves 104 and 106, the base 90 is received in the recess 56 between the legs 58 and 60.

The mounting bracket 88 also includes a pair of L-shaped projections which aid in securing a hood 108 to the connector 20, the hood 108, in turn, clamping the connector 22 against the mounting bracket 88. As illustrated, projections 92 and 94 and the L-shaped projections extend in a common direction and form with base 90 two U-shaped portions and provide stops restricting movement of connector 22 and hood 108 in a side direction transversely to the row of contact rear portions 36 in connector 20.

The projections 92 and 94 may be provided with free ends with arcuate edge portions 93 (only one shown) diverging away from base 90 to aid in the initial insertion of the projections into the grooves 104 and 106 and to form an entry for connector 22. Additionally, the spacing between the projections 92 and 94 may be such that there is a slight frictional fit between the projections and the dielectric body. Of course, the frictional forces may be increased by directing the projections 92 and 94 slightly toward each other.

Figure 10:
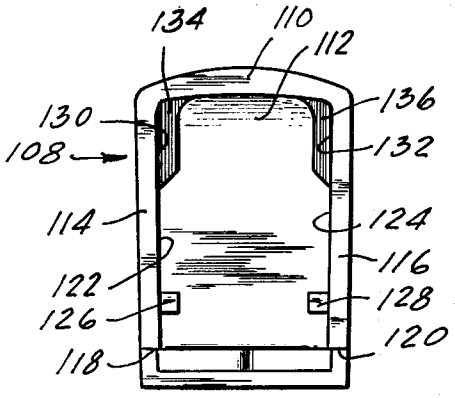
FIG. 10 is an end view of a hood taken substantially along the viewing line X—X in FIG. 1.

As best seen in FIGS. 2 and 10, the hood 108 comprises a top wall 110, an end wall 112 and a pair of side walls 114 and 116 having respective lower edges 118 and 120. The hood 108 is constructed of a resilient material, preferably a plastic material such as Valox 310, and the side walls 114 and 116 extend from the top wall 110 at a slightly convergent angle such that the lower edges 118 and 120 are spaced slightly closer than the transverse width of the connector above the lateral or side flanges 46. The side walls 114 and 116 includes respective inner surfaces 122 and 124 which have respective guide rails 126 and 128 projecting therefrom. The guide rails 126 and 128 are spaced from the lower edges 118 and 120 a distance equal to the spacing between the flanges 46 and the shoulders 48 on each side of the connector 20. Therefore, as the hood 108 is moved toward the right in FIG. 2 the lower edges 118 and 120 slide along the flanges 46 and the guide rails 126 and 128 slide along the shoulder 48 until the flange 42 is received in a slot 140 in a hood portion 138. With the hood so disposed, the L-shaped projections 96 and 98 hook over the right-hand ends of the respective guide rails 128 and 126 and provide at least one surface positioning the hood 108 with respect to connector 22.

With the hood 108 so disposed the inner surface portions 130 and 132 of the surfaces 122 and 124, respectively, engage the side walls 52 and 54 of the connector 22 for lateral stability and an inner surface portion 133 bears on the top 50 of the connector 22 to clamp the connector 22 on the mounting bracket 88.

As indicated in FIGS. 1, 2 and 9, the connector 18 may be secured to the connected 20 by way of a screw 146 which is received through the aperture 142 and the apertured rivet 144 of the connector 20 and into a threaded connection, for example like the threaded rivet 100, in the connector 18. Likewise, a screw 148 may extend through similar apertures in the connector 18 for engagement in the threaded aperture 102 of the rivet 100.

Inasmuch as the mated connectors 18 and 20 may lie on the floor, for example in a business office, and as the apparatus could be subject to water splashing normally encountered when floors are washed, a splash guard in the form of a boot 150 may be provided. The boot 150 is preferably made of rubber and includes an end 156 which fits over the open end of the housing 108 and the connectors 22 and 24 and a smaller end 158 which tightly embraces the cable 26. Retaining ridges, such as the ridges 152 and 154 in FIGS. 1 and 4 may be provided to help retain the boot 150 on the connector assembly.

In a working embodiment of the invention, the connector 20 was an Amphenol Series 57 connector and the connector 22 was a Western Electric Company jack with the designation 623-P. This type of jack has found wide application in the telephone industry and receives a cooperable plug (the connector 24) also manufactured by Western Electric Company. Of course, the connector 18, in this particular construction, is a complementary matable Amphenol Series 57 connector.

The connector 18 accommodates, for example, fifty circuit points of the telephone signaling and switching equipment 12, while the connectors 22 and 24 handle a much lesser number of circuits, for example four to six circuit connections. Therefore, a selective connection is effected by connecting the conductors 37 to selected contacts of the connector 20, that is if a full complement of contacts is employed, or by selective withdrawal and repositioning of the contacts 32 to different locations along the dielectric insert 28. Ordinarily, the conductors 37 are clamped in the tail portion 68 of the contacts 66 and are therefore a part of the connector 32; however, a reconfiguration of the tail portions 68 so as to be provided with conductors at a later time, or the provision of removable contacts 66, will add greater flexibility in circuit selection and association between the signaling and switching equipment and the telephone stations.

It will be noted that actually two embodiments have been illustrated for mounting the connector 22 on the connector 20. In FIG. 1, for example, the mounting bracket extends further in the elongate direction of the connector 20 so that the connector 22 is positioned beyond the flange 44. This permits the connector 22 to receive the base 90 further within the recess 56 than in the embodiment illustrated in FIG. 2 in which the connector 22 is positioned over the flange 44. In the embodiment illustrated in FIG. 1 a slightly lower profile may be obtained, while a slightly shorter overall construction may be obtained with the arrangement illustrated in FIG. 2, although the structural details of two embodiments are otherwise substantially the same.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

What is claimed is:

1. Electrical connector apparatus, comprising:

a first electrical connector including a plurality of first contacts for mating engagement with contacts of a complimentary electrical connector, and a first dielectric body supporting said first contacts;

a second electrical connector including a plurality of second contacts for mating engagement with contacts of another complimentary electrical connector, and a second dielectric body supporting said second contacts, the number of said first contacts being at least equal to the number of said second contacts with said second contacts being electrically connected to selected ones of said first contacts, said second dielectric body including a pair of spaced-apart downwardly extending legs with a recess therebetween; and mounting means mounting said second dielectric body on said first electrical connector adjacent said first dielectric body, said mounting means including a mounting bracket connected to said first electrical connector, said mounting bracket including a base which is received in the recess with said legs disposed on opposite sides of said base.

2. A mounting member for use with first and second contact support means carrying first and second contact members with active and rear portions, and cover means for at least partially covering said rear portions, comprising:

mounting means for mounting to said first contact support means, base means for supporting the second contact support means with the active portions thereof oriented away from the rear portions of the first contact support means, and stop means carried by said base means and disposed for restricting movement of said second contact support means.

3. The mounting member of claim 2 including second stop means for restricting movement of said cover means, and including at least one surface for at least partially positioning said cover means with respect to said second contact support means wherein said first and second stop means each include a pair of projections extending in a common direction and forming with said base means two U-shaped portions.

4. The mounting member of claim 2 including a first end portion with said mounting means, a second end portion with said base means, and opposite side portions with said stop means.

5. The mounting members of claim 4 wherein the pair of projections of said first stop means include free end portions diverging in a direction away from said base means to form an entry for said second contact support means.

6. A mounting member for use with first and second contact support means and cover means, comprising:

mounting means for mounting to said first contact support means, base means for supporting the second contact support means, stop means carried by said base means including at least one projection for engagement with said second contact support means restricting movement thereof in at least one direction, and at least one surface for at least partially positioning of said cover means with respect to said second contact support means.

7. A connector adapted assembly for use in a telephone system in interconnecting a multi-conductor first cable to a multi-circuit member having fewer circuits than the number of conductors in said first cable with said first cable and multi-circuit member being connected to matable connector units, the assembly comprising:

first and second contact support means including respective first and second dielectric portions with respective first and second contact support surfaces arranged for spaced apart support of contact members engageable with contact elements of said matable connector units, each of said support surfaces arranged for supporting an individual contact member with the number of said first surfaces being greater in number than the number of said second surfaces, first contact members supported in a predetermined pattern by at least a portion of said first contact support surfaces for connection to predetermined contact elements in one of said matable connector units and predetermined conductors in said first cable, and including rear portions, second contact members supported by said second contact support surfaces arranged for engagement with a second of said matable connector units and including rear portions, means electrically interconnecting the rear portions of said second contact members to selected rear portions of said first contact members, and means for supporting said second support means by said first support means.

8. The connector adapter assembly of claim 7 wherein said first contact members are supported in selected ones and less than all of said first contact support surfaces for a predetermined interconnection between said multi-circuit member and said first cable, with said means electrically interconnecting said second contact members with said first contact members.

9. A bracket for mounting a first electrical connector unit on a second electrical connector unit, comprising:

first means for releasably receiving at least a portion of the first electrical connector unit therein;

second means adapted for connection to the second electrical connector unit; and third means interconnecting said first means and said second means.

10. A bracket according to claim 9, wherein said first means includes a pair of spaced projections extending from said third means for receiving the first electrical connector unit therebetween in a frictional fit.

11. A bracket according to claim 10, wherein said projections are directed slightly toward each other to provide an increase in the frictional forces with the first electrical connector unit.

12. A bracket according to claim 9, wherein said third means includes a plate-like base, and said second means includes means defining a hole in said base for receiving a fastening element.

13. A bracket for mounting a first electrical connector unit on a second electrical connector unit, the first electrical connector unit having grooves on opposite sides and the second electrical connector unit having a flange, said bracket comprising:

a base plate for disposition on and to be supported by the flange of the second electrical connector unit, said base plate adapted for connection to the flange; and a pair of projections directed from said base plate spaced apart to extend into respective ones of the grooves and embrace the first electrical connector unit.

14. A bracket according to claim 13, wherein each of said projections includes an arcuate edge portion adjacent the distal end thereof to aid in guiding said projection into the respective groove.

15. A mounting bracket for mounting a first electrical connector unit on a second electrical connector unit and securing a hollow hood thereto, the first electrical connector unit having grooves on opposite sides, the second electrical connector unit being elongate and having an end flange, and the hood adapted to cover both of the connector units and having a pair inwardly directed projections, said bracket comprising:

a base plate for disposition on the end flange of the second connector unit and adapted for connection thereto;

a pair of first projections extending from said base plate to receive the first electrical connector unit therebetween and to be received in the grooves of the first electrical connector unit; and a pair of hook-shaped second projections extending from said base for engaging the inwardly directed projections of the hood.

16. The mounting bracket of claim 15, wherein said base plate, said first projections and said second projections are formed as a one-piece metal structure.

17. Electrical connector apparatus, in combination comprising:

a first electrical connector unit including a first dielectric body having grooves on opposite sides thereof and a plurality of first electrical contacts supported by said first dielectric body;

a second electrical connector unit including a second dielectric body, a pair of flanges extending from said second dielectric body, and a plurality of second contacts supported by said second dielectric body and greater in number than said first electrical contacts;

electrical connection means connecting said second electrical contacts to respective selected ones of said first electrical contacts;

a mounting bracket including a base secured to one of said flanges and first projections extending from said base and into said grooves to frictionally engage and receive said first dielectric body therebetween, and hook-shaped second projections extending from said base; and a hollow hood covering said first and second dielectric bodies and said electrical connection means, said hood connected to the other of said flanges and including internal projections releasably engaged by said hook-shaped members.

18. A connector adapter assembly for use in interconnecting a multi-conductor first cable to a multi-conductor second cable in a telephone system, the second cable including fewer conductors than said first cable and each of the cables connected to connector units, the assembly comprising:

first and second contact support means including first and second dielectric portions, with a first and second plurality of contact support surfaces, respectively, said second contact support surfaces being fewer in number than the number of said first contact support surfaces, first and second contact members with active portions each supported on one of said supporting surfaces in spaced apart predetermined patterns adapted for mating with said first and second connector units, said first and second contact members including rear portions and said first contact members being at least equal to the number of the second contact members, and means electrically interconnecting the rear portions of said second contact members to selected ones of the first contact members, said contact support means including cover means and first and second contact support means supporting said first and second contact members respectively with said first contact support means including a mounting member supporting said second contact support means and said cover means being positioned adjacent said member, said cover means substantially enclosing the rear portions of the first contact members and at least a portion of the second contact support means, said mounting member including a base portion supporting said second contact support means and said cover means including a projection extending over said second contact support means for retention thereof, said base portion and said projection each including a U-shaped portion providing upper and lower lateral stops to lateral movement of said second contact support means.

19. The assembly of claim 18 wherein said cover means includes a resilient boot fitted around said base portion and projection.

20. The assembly of claim 18 wherein said mounting member includes mounting means for mounting to said first contact support means.

21. Electrical connector apparatus, comprising:

a first electrical connector including a plurality of first contacts for mating engagement with contacts of a complementary electrical connector, a first dielectric body supporting said first contacts, and a shell embracing said first dielectric body and defining a forward end of said first electrical connector, said shell including an end flange;

a second electrical connector including a plurality of second contacts for mating engagement with contacts of another electrical connector, and a second dielectric body supporting said second contacts, said second contacts electrically connected to respective ones of said first contacts; and mounting means mounting said second electrical connector on said end flange of said first electrical connector, said second dielectric body including a pair of opposite lateral sides each having a groove therein, said mounting means comprising a bracket connected to said end flange, said bracket including a pair of spaced projections, each of said projections extending into a respective groove in said dielectric body, and said bracket including a pair of spaced arms extending therefrom on opposite sides of said first dielectric body.

22. Electrical connector apparatus, comprising:

a first electrical connector including a plurality of first electrical contacts for mating engagement with respective contacts of a cooperable mating electrical connector, an elongate first dielectric body supporting said first electrical contacts, and a shell embracing a portion of said first dielectric body and including first and second end flanges adjacent opposite ends of said first dielectric body;

a second dielectrical connector including a plurality of second electrical contacts for mating engagement with respective contacts of another cooperable mating electrical connector, and a second dielectric body supporting said second electrical contacts, said second electrical contacts connected to respective ones of said first electrical contacts;

a mounting bracket supporting said second electrical connector and connected to said first end flange; and a hollow hood covering said first and second dielectric bodies, said hood secured to said second end flange and comprising internal surfaces engaging and holding said second electrical connector on said mounting bracket.

23. Electrical connector apparatus, comprising:

a first electrical connector including a plurality of first contacts for mating engagement with contacts of a complementary electrical connector, and a first dielectric body supporting said first contacts;

a second electrical connector including a plurality of second contacts for mating engagement with contacts of another complementary electrical connector, and a second dielectric body supporting said second contacts, the number of said first contacts being at least equal to the number of said second contacts with said second contacts being electrically connected to selected ones of said first contacts, said second dielectric body including a pair of spaced-apart downwardly extending legs with a recess therebetween;

mounting means mounting said second dielectric body on said first electrical connector adjacent said first dielectric body, said mounting means including a mounting bracket connected to said first electrical connector, said mounting bracket including a base which is received in the recess with said legs disposed on opposite sides of said base; and a hood connected to said first electrical connector, said hood covering at least portions of said first and second dielectric bodies and holding said second dielectric body against said mounting bracket, said hood including a top and a pair of spaced resilient sidewalls with lower edges, each of said sidewalls extending from said top at an angle such that said lower edges are spaced less than the junctions of said sidewalls with said top for gripping said first and second connectors therebetween.

24. A method of assembling a first electrical connector having a groove therein to a second electrical connector and to a protective hood which has a closed end, an open end and a lateral projection extending therefrom, with a mounting bracket having a first projection and a second projection, comprising the steps of:

first, fastening the mounting bracket to the second connector;

then, placing the first connector on the mounting bracket by slidably engaging the first projection of the bracket in the groove of the first connector; and then, sliding the open end of the hood over the second connector in the direction of the first connector until the second projection of the bracket engages the lateral projection of the hood.

25. Electrical connector apparatus comprising:

a first electrical connector including a first insulating member having a rear, a plurality of first electrical contact portions supported by said first insulating member at said rear, first mating means for mating with a complementary connector, and a pair of ends;

a protective cover enclosing said rear of said insulating member and said first contact portions, including walls defining an opening adjacent one of said ends;

a second electrical connector including a second insulating member, a plurality of second electrical contact portions supported by said second insulating member and each electrically connected to a respective one of said first electrical contact portions and second mating means for mating with a different complementary electrical connector; and mounting means mounting said second electrical connector on said one end and at least partially within said walls.

26. Electrical connector apparatus according to claim 25, wherein said one end comprises a flange and said mounting means comprises a mounting bracket supporting said second electrical connector, and fastening means securing said bracket to said flange.

27. Electrical connector apparatus according to claim 26, wherein said second insulating member comprises a pair of side surfaces each including a groove therein, and wherein said bracket includes a pair of spaced apart projections received in said grooves.

28. Electrical connector apparatus according to claim 26, wherein said protective cover comprises a pair of spaced apart projections, and said mounting bracket comprises a pair of members engaging said projections to secure said cover to said first electrical connector adjacent said one end.

* * * * *